US005645653A

United States Patent [19]

Jerath et al.

[11] Patent Number: 5,645,653

[45] Date of Patent: Jul. 8, 1997

[54] RAILS

[75] Inventors: Vijay Jerath, Yorshire; David J. Price, Scunthorpe; Ian W. Martin, South Yorkshire, all of Great Britain

[73] Assignee: British Steel plc, Great Britain

[21] Appl. No.: 557,169

[22] PCT Filed: Jun. 20, 1994

[86] PCT No.: PCT/GB94/01326

§ 371 Date: Feb. 22, 1996

§ 102(e) Date: Feb. 22, 1996

[87] PCT Pub. No.: WO95/00707

PCT Pub. Date: Jan. 5, 1995

[30] Foreign Application Priority Data

Jun. 24, 1993 [GB] United Kingdom ..... 9313060

[51] Int. Cl.[6] ..... E01B 5/08; C21D 9/04

[52] U.S. Cl. ..... 148/320; 238/150

[58] Field of Search ..... 148/320, 334, 148/336; 238/150; 428/610, 596

[56] References Cited

U.S. PATENT DOCUMENTS

| | | | |
|---|---|---|---|
| 1,080,590 | 12/1913 | Russell | 148/320 |
| 1,837,189 | 12/1931 | Kenney | 148/320 |
| 3,556,499 | 1/1971 | Hammon | 238/122 |
| 3,658,602 | 4/1972 | Pomey | 148/582 |
| 4,375,995 | 3/1983 | Sugino et al. | 148/584 |
| 4,389,015 | 6/1983 | Guntermann et al. | 238/150 |
| 4,486,248 | 12/1984 | Ackert et al. | 148/145 |
| 4,575,397 | 3/1986 | Heller | 148/320 |
| 4,767,475 | 8/1988 | Fukuda et al. | 148/320 |
| 5,482,576 | 1/1996 | Heller et al. | 148/334 |

FOREIGN PATENT DOCUMENTS

| | | | |
|---|---|---|---|
| 719588 | 10/1965 | Canada | 238/150 |
| 93/14230 | 7/1993 | WIPO . | |

OTHER PUBLICATIONS

Database WPI, Week 8433, Derwent Publications Ltd., London GB; AN 84–203941 & JP.A,59 116 321 (Nippon Steel Corp.) 5 Apr. 1984.

*Primary Examiner*—John Zimmerman
*Attorney, Agent, or Firm*—Bacon & Thomas

[57] ABSTRACT

A rail for use in a railway which has in section, a head having a traffic carrying surface and a foot, wherein the head comprising a traffic carrying surface is composed of low carbon martensite.

9 Claims, 8 Drawing Sheets

RAILS

This application was filed under 35 USC 371 from PCT/GB94/01326 filed Jun. 20, 1994.

BACKGROUND OF THE INVENTION

1. Field of the Invention

This invention relates to rails and in particular to rails exhibiting improved strength, hardness and toughness.

2. Description of Related Art

The problems with making rails for railways are well known and may be summarised as the difficulty of providing both a hard running surface together with a tough rail which in this technology means having a resistance to fracture. Treatments of the head to make it hard are well known, but in general are found to have corresponding deleterious effects on the toughness. The rail must be able to resist the propagation of fatigue cracks.

Modern high performance rails are currently made by rolling steel of an appropriate composition and then cooling it. The rail may be cooled either directly after leaving the rolling mill, perhaps having been reheated, or after subsequent heat treatment. Cooling is controlled and the object is to create pearlite as the main component of the rail head. This pearlite has particular qualities of hardness and the cooling rate is in fact controlled to be below a particular rate for the steel composition in question so that it passes into what is known as the perlitic area on the continuous cooling transition (CCT) diagram for the steel. In some cases the cooling may be particularly controlled so that the path on the CCT diagram to passes through what is known as the "perlitic nose" when a pearlite of a fine inter lamellar spacing and consequently higher strength and hardness is produced. Unfortunately modern rail technology is now approaching the limits of hardness that can be achieved by a perlitic head because of the reductions in toughness brought about by the processing for increased hardness.

SUMMARY OF THE INVENTION

It is therefore an object of the present invention to provide a rail having an improved fracture toughness impact resistance for a given hardness.

According to the present invention there is provided a rail for use in a railway having a head and a foot the head being a traffic carrying surface composed of low carbon martensite. The rail may be rolled from a low carbon steel, and the head, and optionally the foot, may be rapidly cooled by the application of water or water/air sprays. The carbon content of the rail may be between 0.1 and 0.4% and the rail may have alloying elements to improve the hardenability and may also contain titanium and niobium. The hardenability may fall into the ranges shown in Table 3 and the rail may be allowed to self temper by terminating the spray cooling and allowing the residual heat in the rail head to equalise under natural cooling.

The invention will now be described by way of example and with reference to the accompanying drawings

DETAILED DESCRIPTION OF THE INVENTION

Figure 1:
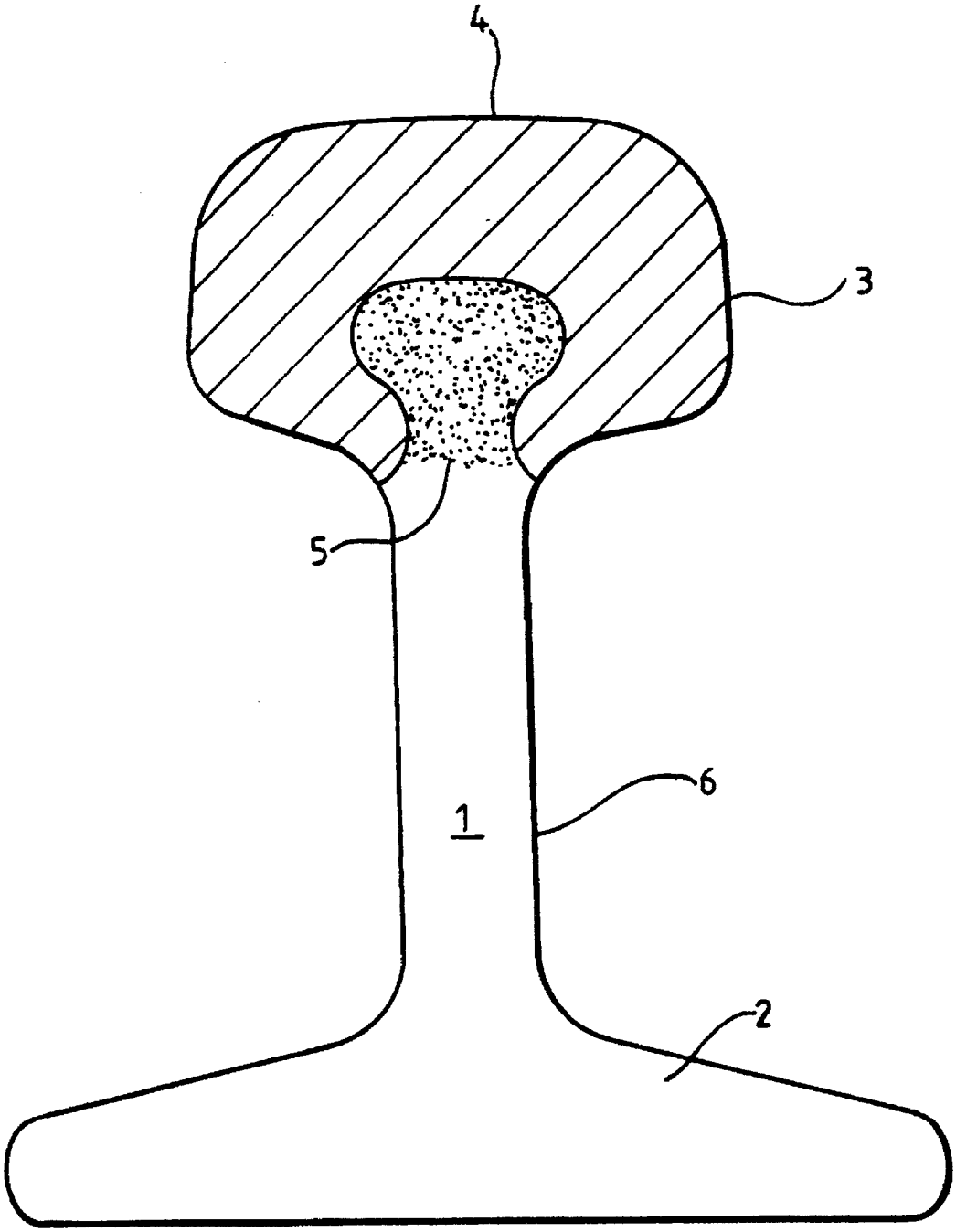
FIG. 1 is a diagram of a martensitic headed rail.
Figure 2:
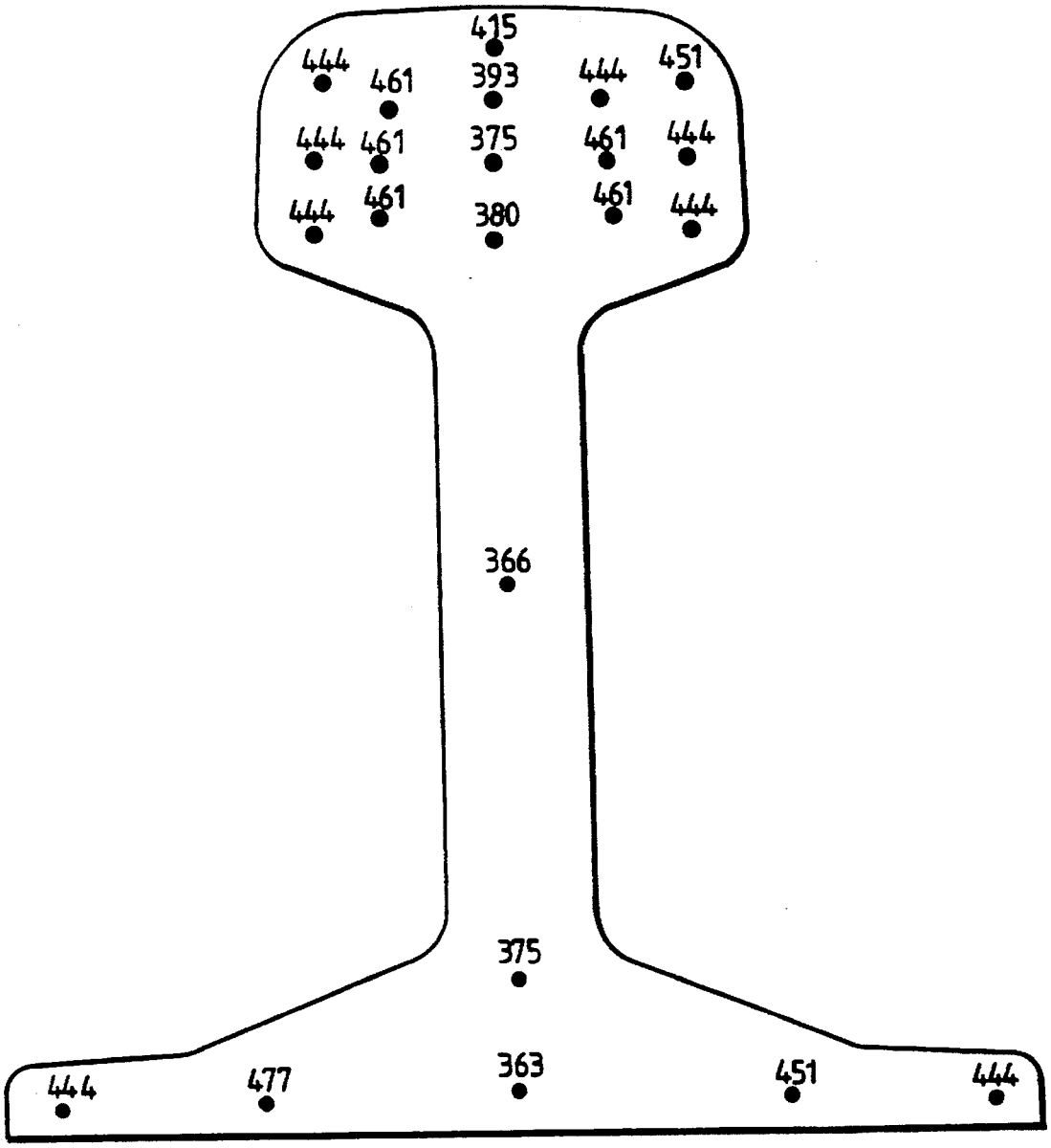
FIG. 2 is a representation of the Brinell hardness results for such a rail
Figure 3:
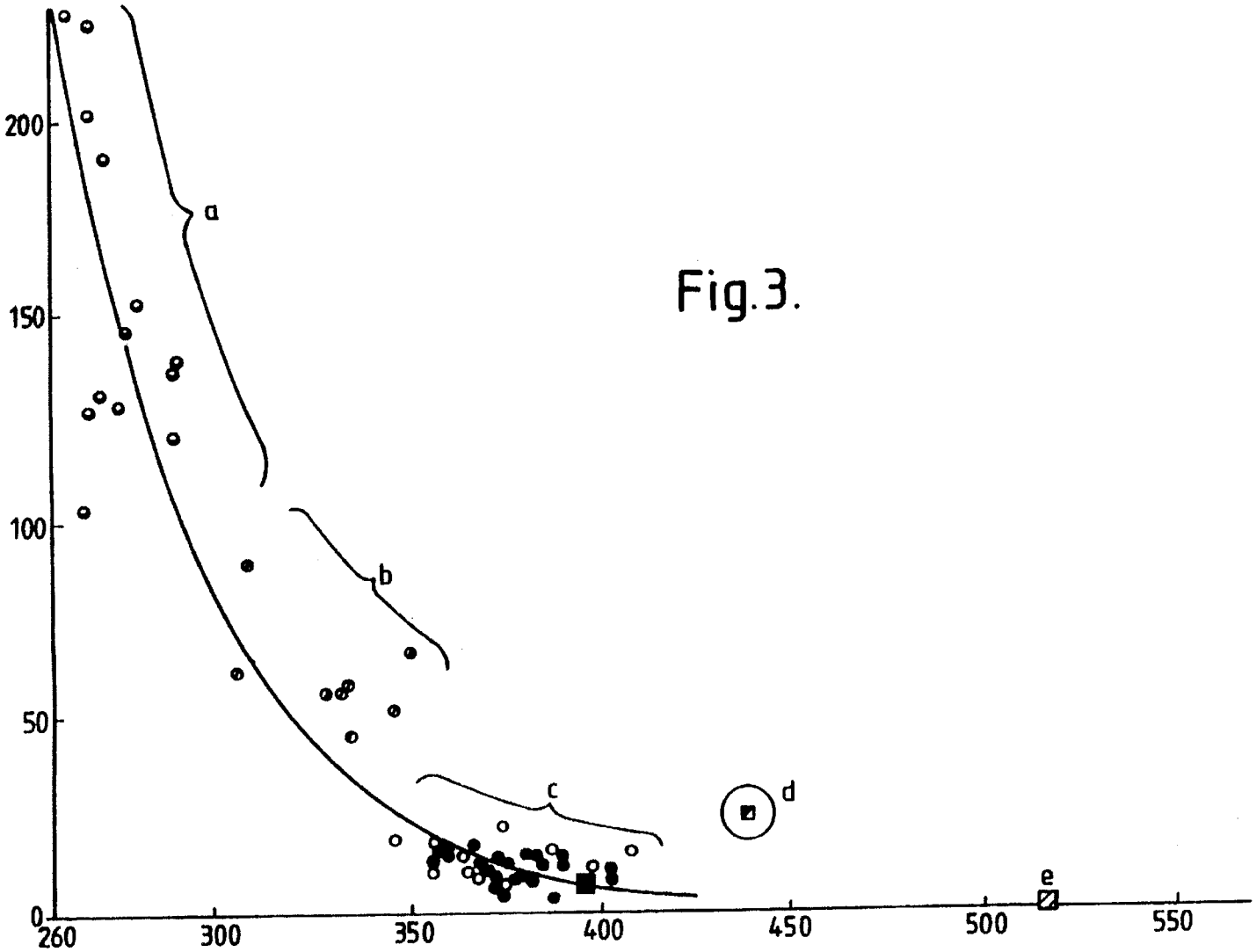
FIG. 3 is a diagram of the relationship between wear rate and hardness for pearlitic and martensitic rails.

Turning now to FIG. 1 this shows a conventionally shaped flat bottomed railway rail 1. It has a foot 2 and head 3. The micro structure of the head in the shaded area 4 is martensite, while in region 5, where clearly the rate of cooling from external sprays is less it is a mixture of martensite and bainite. Where the foot has been cooled it is also largely martensite and the composition of the web 6 joining the foot and the head is not usually of great significance since in practice the performance required for the web is exceeded by most rails steels and heat treatments. The rail is made from a low carbon steel of composition as shown in Table 1. Brinell hardness tests were conducted on a section of such a rail and the results are shown in FIG. 2. A comparison of the Brinell hardness for various rails is shown in FIG. 3 where these are plotted along the abscissa. The ordinate is the wear rate in milligrammes per meter of slip. The rails fall into four groups: (a) in as-rolled condition and (b) is a 1% chromium steel, again in as rolled condition. The results (c) are those of various head hardened and heat treated pearlitic rails of conventional manufacture while (d) is the low carbon martensitic steel rail of the invention. It will be seen from FIGS. 2 and 3 that the hardness of the martensitic rail is high, and the wear rate is clearly comparable with modern day pearlitic rails.

Figure 5:
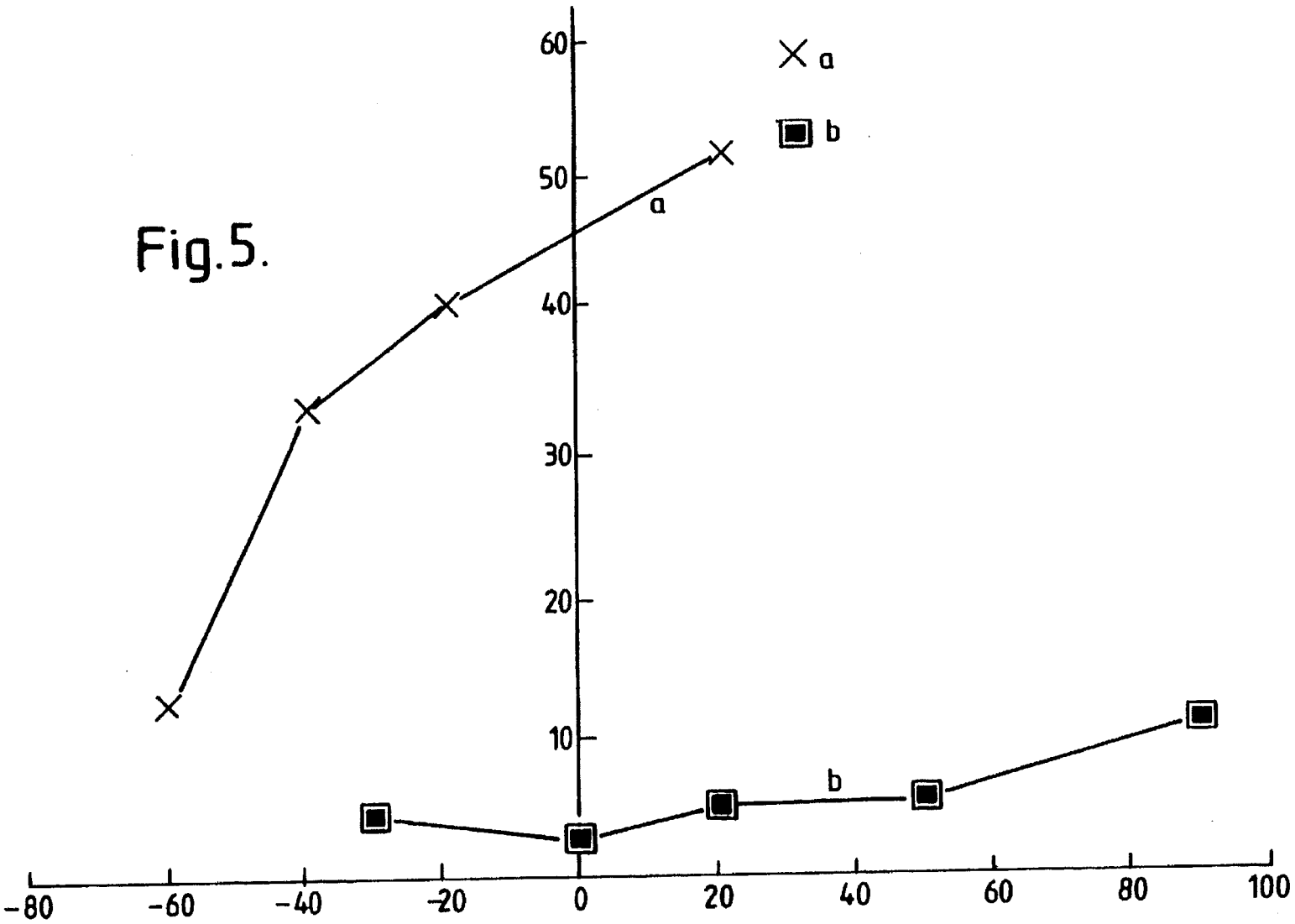
FIG. 5 is a diagram of the variation of the Charpy V-notch impact energy for martensitic and pearlitic rails at varying temperatures.

Charpy V-notch impact resistance tests which are used to measure toughness are summarised in FIG. 5. Here with temperature is shown as the abscissa and the ordinate is the impact energy in joules. The results (a) are for a low carbon martensitic steel of the invention rolled to 113 pounds per yard, and those for a typical mill heat treated pearlitic steel containing 0.01% titanium, again at 113 pounds per yard is shown at (b). The martensitic rail had a tensile strength of 1,550 $N/mm^2$ and the elongation at break was 10%; the Brinell hardness was 445. The corresponding figures for the pearlitic steel were a tensile strength of 1,210 $N/mm^2$, and an elongation at break of 10%, and Brinell hardness of 360. This clearly shows that the resistance to fracture initiation is higher in the martensitic rail than the pearlitic, even at low temperatures.

The fracture toughness of the martensitic rail has found to be between 100 and 110 $MpA/m^{1/2}$, compared to typical values for pearlitic rails of 35–40 $MPam^{1/2}$.

It has also been found that the fatigue crack resistance (da/dN) is broadly similar to that for current heat treated rails, although it has been empirically observed that the fatigue cracks in the martensitic rails propagate further before the onset of fast or catastrophic failure. The production of such low carbon martensitic headed rails is relatively simple, the essential need being to cool the rail rapidly so as to avoid passing through the "pearlitic nose" in the continuous cooling transition diagram, a well known diagram in the metallurgy of steel.

Figure 8:
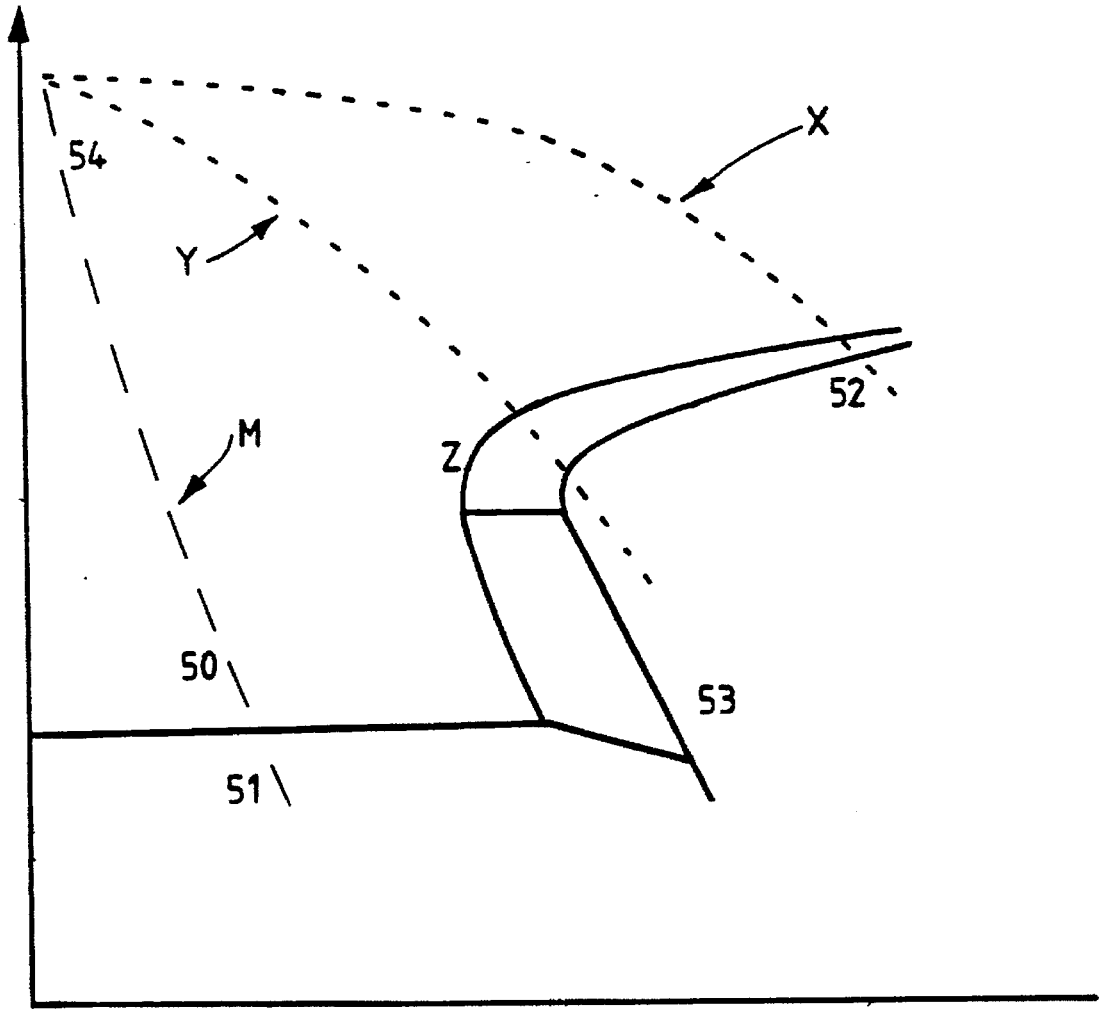
FIG. 8 is a schematic representation of the continuous cooling transformation diagram for a 0.8% carbon steel.

Such a diagram is shown in FIG. 8 which is for 0.8% carbon steel. The area 54 is austenite (the form of steel at high temperatures), and temperature is shown on the ordinate and time, on a log scale is shown on the abscissa. Austenite is present at 50 and martensite at 51. Pearlite is shown by 52 and Bainite by 53. In between these areas a mixture of steel microstructures is produced. Dotted path X presents the path for normal air cooling and it will be seen that the path leads to the pearlitic state. The point marked Z is that point known as the pearlite nose, and controlled cooling along the path Y aims to pass the rail through the pearlitic nose producing the fine pearlite previously mentioned.

The path M marks a typical path for the production of a martensitic rail, and it would be seen that it passes directly from the austenitic region to the martensitic region. Clearly this requires a high rate of cooling and this is achieved by the use of water, either as simple water sprays or mixed air water sprays.

Figure 4:
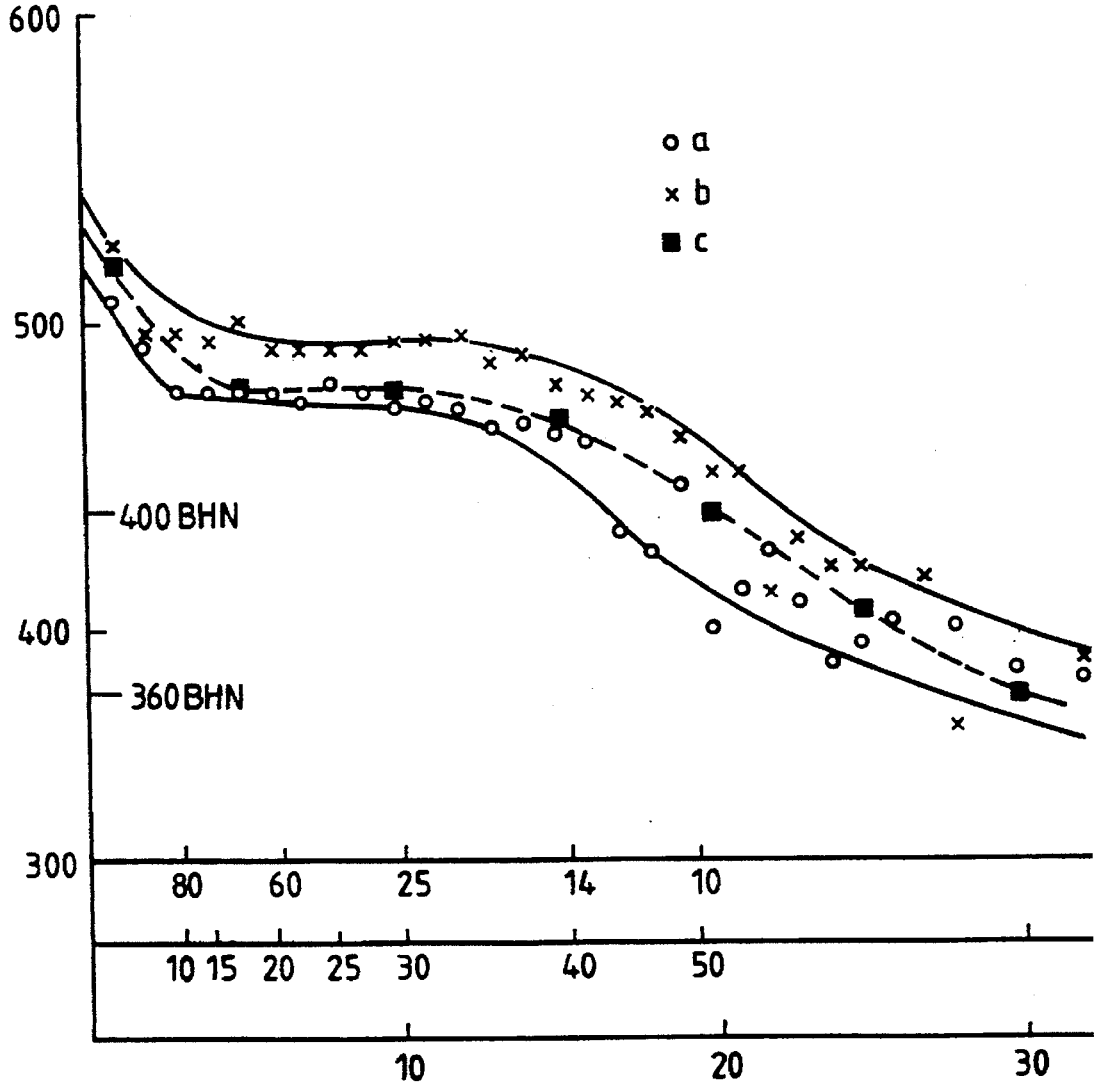
FIG. 4 is a diagram of the Jominy Hardenability data for a low carbon alloy steel.

An important consideration in the production of rails is the quality known as hardenability. This is the ability of a steel to achieve a given hardness at a point remote from the point of application of cooling, particularly forced cooling. The hardenability data for a low carbon steel of the composition given in Table 1 is shown in FIG. 4. This shows as the ordinate the Brinell hardness (BHN) and the abscissa are, from top to bottom, cooling rate in degree Celsius per second at 700° C., the equivalent plate thickness in mm, and the distance from the quenched face in mm. Data reference (a) is for a thickness of 40 mm and that at (b) is for 65 mm. This diagram shows the variation in Brinell hardness as one progresses further from the quenched outside surface of the rail. Hardenability of this steel is acceptable because the martensite is produced at these deeper levels. The main elements that re known to effect hardenability are manganese, to a lesser, molybdenum, vanadium, chromium, nickel and copper. The calculation of hardenability from alloying elements is quite difficult, and although it can be predicted to a reasonable extent it must in the end always be measured. In FIG. 4 the data for point (c) are from laboratory based steel melts. The elements titanium and niobium are added for the usual reasons, titanium to improve weldability and niobium as a general precipitation strengthening element. Thus the process produces a rail with the hardenability characteristics of a high carbon steel while also allowing the formation of a low carbon martensite with its correspondingly high intrinsic hardness.

Figure 7:
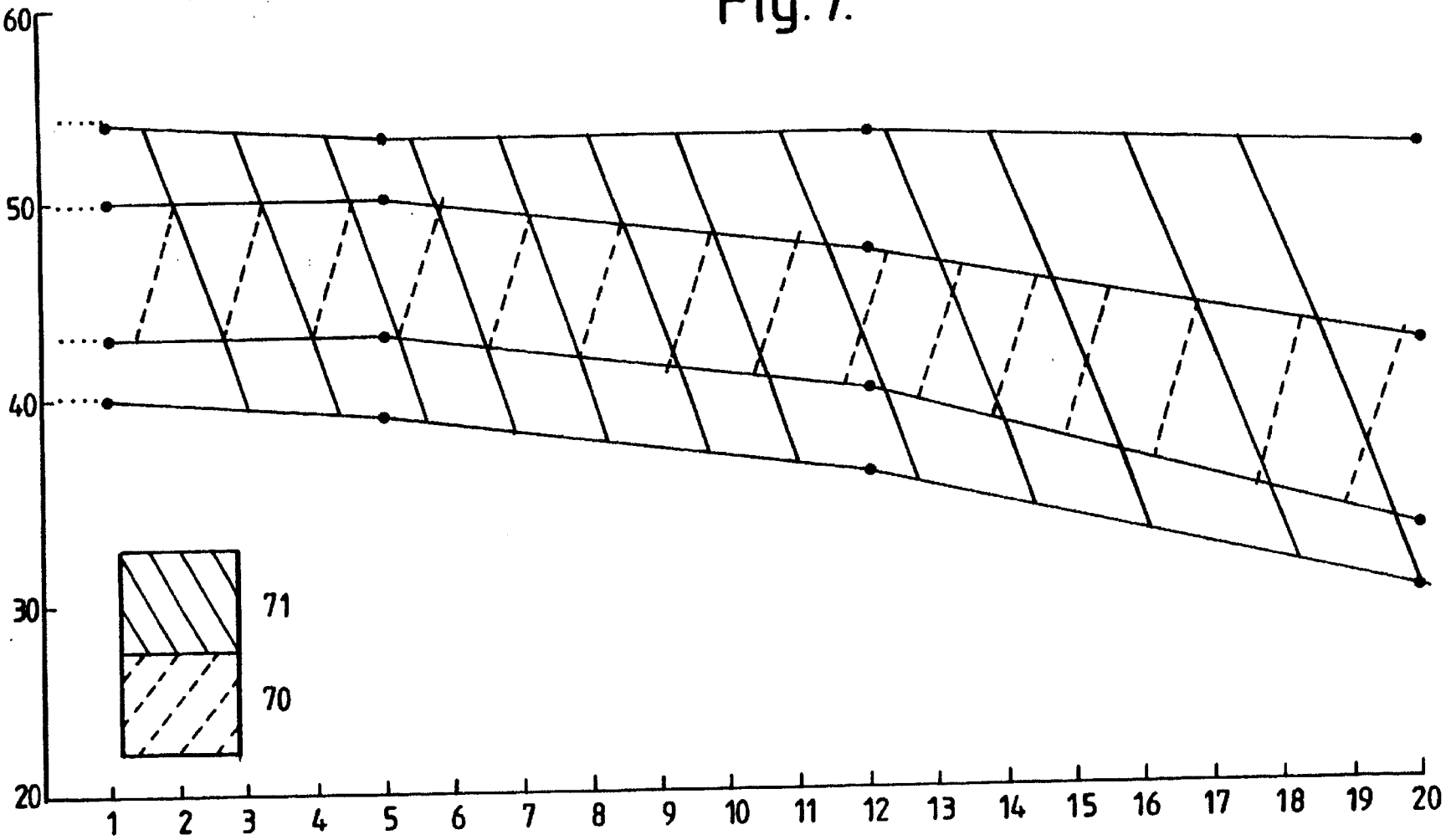
FIG. 7 is a diagram of the hardenability bands for the production of martensitic rails.

FIG. 7 shows the acceptable hardenability bands and these are also set out in Table 3. The preferred hardenability band is shown for the J positions (sixteenths of an inch from the quenched end of a 1.0 inch diameter bar) 1, 5, 12 and 20. The area 70 is the preferred band although the area 71 would be acceptable for such rails.

Figure 6:
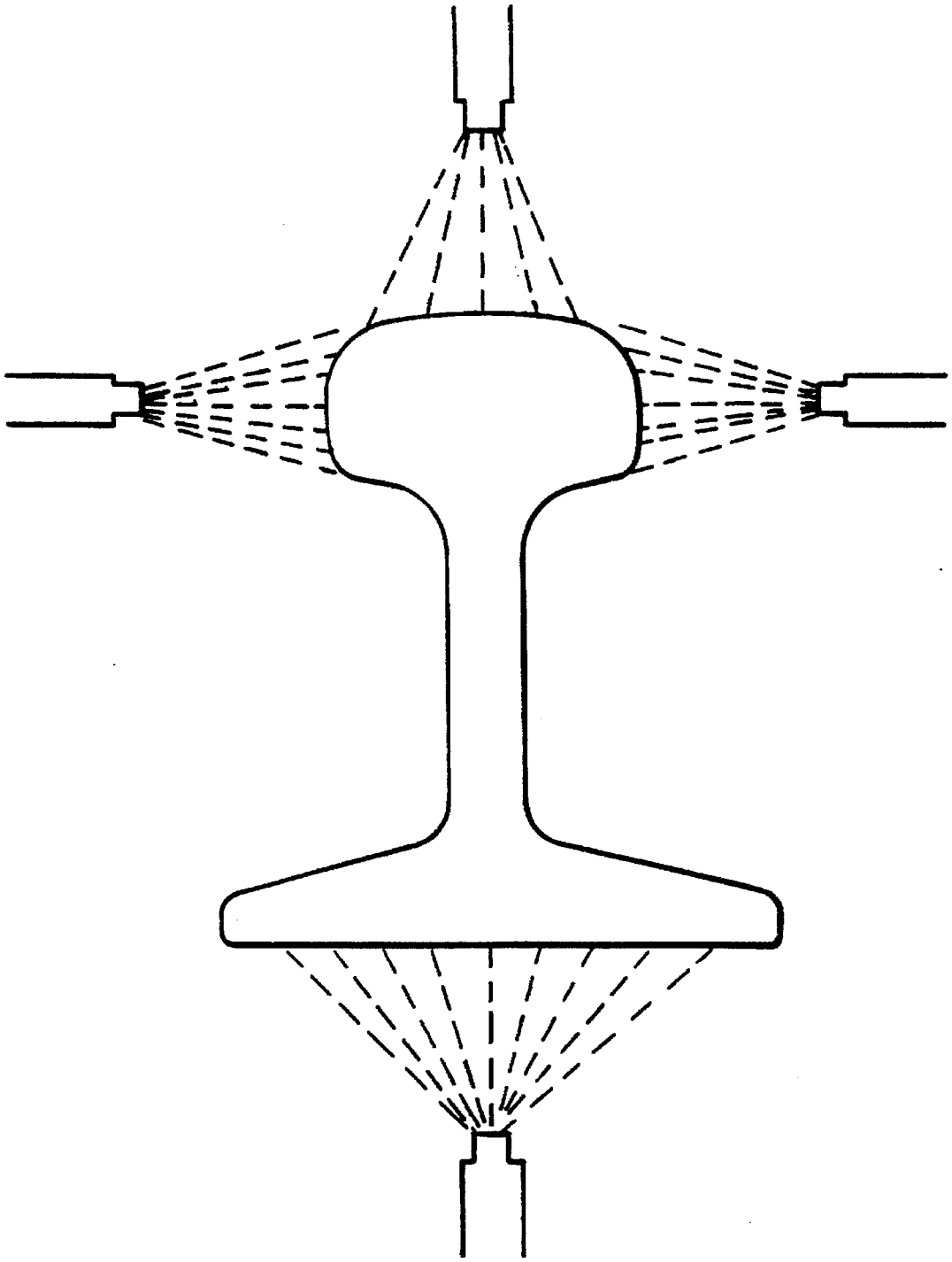
FIG. 6 is a schematic diagram of one cooling arrangement for the production of rails.

FIG. 6 shows a typical arrangement of the sprays that might be used to produce the cooling required for such a martensitic rail.

The compositions for grades of martensitic rail steels that have been found to lie within the preferred hardenability bands are set out in Table 2 where each grade shows the range of compositions that might fall within it.

Further advantage of martensitic rail is that the higher intrinsic hardness of martensite, required levels of hardness are easier to achieve. Therefore the manufacturing process can be modified so that less attention need be paid to the optimising of the hardness of the head, with the results that the parameters for the process can be varied to improve other characteristics. In particular, self tempering of the rail head to produce a higher feature toughness and impact resistance can be carried out by stopping the spray when the core of the inside of the rail head has fallen to temperatures of up to approximately 500° C. The rail is then allowed to cool naturally, and the heat from the interior of the rail head will spread to the whole of the head slowly raising the temperature before the whole rail finally cools to ambient.

In summary it is to be understood that the invention is based upon the discovery that, contrary to widespread and probably universally held belief by those in the technology that martensitic metallurgy in rail heads is to be avoided, rail heads can comprise low carbon martensite. Following the making of the inventive concept of utilising low carbon martensitic steel, the applicants found that the relevant paremeters of interest for rails concerning what can somewhat loosely be called "hardness", namely rolling contact wear and rolling contact fatigue, have surprisingly been found to be satisfied and that the rail is of a fully acceptable hardness well into the head.

Thus the applicants have provided a good wearing rail, and a rail having good resistance to damage from derailment, for example, when compared with other currently available rails.

TABLE 1

| Element | Amount (Wt. %) |
|---|---|
| Carbon | 0.23 |
| Silicon | 0.40 |
| Manganese | 1.31 |
| Phosphorus | 0.016 |
| Sulphur | 0.004 |
| Chromium | 0.31 |
| Molybdenum | 0.30 |
| Niobium | 0.032 |
| Vanadium | 0.038 |
| Aluminium | 0.039 |
| Titanium | 0.022 |
| Boron | 0.002 |
| Balance | Iron and incidental impurities |

TABLE 2

TYPICAL COMPOSITIONS FOR COMMERCIAL PRODUCT OF MARTENSITIC RAIL STEELS

| | COMPOSITION Wt % | | | | | | | | | |
|---|---|---|---|---|---|---|---|---|---|---|
| Grade | C | Si | Mn | Cr | Mo | Nb | Al | V | Ti | B |
| 400 | 0.13 | 0.30 | 1.15 | 0.20 | 0.45 | 0.02 | 0.02 | 0.02 | 0.02 | 0.0015 |
| | 0.18 | 0.40 | 1.35 | 0.30 | 0.55 | 0.04 | 0.04 | 0.06 | 0.04 | 0.0025 |
| 450 | 0.20 | 0.30 | 1.30 | 0.25 | 0.25 | 0.02 | 0.02 | 0.02 | 0.02 | 0.0015 |
| | 0.25 | 0.40 | 1.40 | 0.35 | 0.04 | 0.04 | 0.06 | 0.04 | 0.05 | 0.0025 |
| 500 | 0.30 | 0.30 | 1.30 | 0.45 | 0.45 | — | — | — | — | — |
| | 0.35 | 0.40 | 1.40 | 0.55 | 0.55 | 0.04 | 0.04 | 0.06 | 0.04 | 0.0025 |

TABLE 3

HARDENABILITY BANDS FOR THE PRODUCTION OF MARTENSITIC RAILS

| | J-Position (1/16th Inch) | | | | |
|---|---|---|---|---|---|
| | $J_1$ | $J_5$ | $J_{12}$ | $J_{20}$ | |
| max. (HRC) | 50 | 50 | 47 | 42 | Preferred |
| min. (HRC) | 43 | 43 | 40 | 33 | Hardenability Band |
| max. (HRC) | 54 | 53 | 53 | 53 | Acceptable |
| min. (HRC) | 40 | 39 | 36 | 30 | Hardenability Band |

We claim:

1. A rail for use in the railway having, in section, a head and a foot, wherein the head comprises a traffic carrying surface composed of martensite of up to 0.4% by weight carbon and up to 1% by weight chromium.

2. A rail as claimed in claim 1 wherein the head is rapidly cooled by the application of water.

3. A rail as claimed in claim 1 wherein the head and the foot are rapidly cooled by the application of water.

4. A rail as claimed in claim 1 wherein the carbon content thereof is between 0.1% and 0.4% by weight.

5. A rail as claimed in claim 1 including hardenability improving alloying elements.

6. A rail as claimed in claim 1 wherein the rail includes titanium and niobium.

7. A rail as claimed in claim 1 wherein the rail in its formation is allowed to self-temper by terminating the sprayed cooling and allowing the residual heat in the rail head to equalize under natural cooling.

8. A rail as claimed in claim 1 wherein the hardenability thereof is with the range:

| | J-Position (1/16th inch) | | | |
|---|---|---|---|---|
| | $J_1$ | $J_5$ | $J_{12}$ | $J_{20}$ |
| max. (HRC) | 54 | 53 | 53 | 52 |
| min. (HRC) | 40 | 39 | 36 | 30 |

where the $J_n$ position is the position "n" sixteenths of an inch from the quenched end of a 1.0 inch diameter bar subjected to a Jominy end quench test.

9. A rail as claimed in claim 8 wherein the hardenability thereof is with the range:

| | J-Position (1/16th inch) | | | |
|---|---|---|---|---|
| | $J_1$ | $J_5$ | $J_{12}$ | $J_{20}$ |
| max. (HRC) | 50 | 50 | 47 | 42 |
| min. (HRC) | 43 | 43 | 40 | 33 |

where the $J_n$ position is the position "n" sixteenths of an inch from the quenched end of a 1.0 inch diameter bar subjected to a Jominy end quench test.

* * * * *